US010549555B2

(12) United States Patent
Veis et al.

(10) Patent No.: US 10,549,555 B2
(45) Date of Patent: Feb. 4, 2020

(54) MEDIA SUPPORT

(71) Applicant: HP Scitex Ltd., Netanya (IL)

(72) Inventors: Alex Veis, Kadima (IL); Yaron Dekel, Gan-Yeoshaya (IL); Yuval Dim, Moshav Haniel (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 16/277,776

(22) Filed: Feb. 15, 2019

(65) Prior Publication Data

US 2019/0176493 A1 Jun. 13, 2019

Related U.S. Application Data

(63) Continuation of application No. 14/908,197, filed as application No. PCT/IL2013/051046 on Dec. 19, 2013, now Pat. No. 10,259,237.

(30) Foreign Application Priority Data

Jul. 28, 2013 (IL) ..... 50639
Nov. 12, 2013 (IL) ..... 50932

(51) Int. Cl.

| | |
|---|---|
| ***B41J 11/00*** | (2006.01) |
| ***B41J 11/06*** | (2006.01) |
| ***B41J 13/00*** | (2006.01) |
| ***B41J 13/22*** | (2006.01) |

(52) U.S. Cl.

CPC ..... *B41J 11/0085* (2013.01); *B41J 11/006* (2013.01); *B41J 11/06* (2013.01); *B41J 13/0072* (2013.01); *B41J 13/226* (2013.01)

(58) Field of Classification Search

None

See application file for complete search history.

(56) References Cited

U.S. PATENT DOCUMENTS

| | | | | |
|---|---|---|---|---|
| 3,306,805 A | | 2/1967 | Klein et al. | |
| 3,720,433 A | | 3/1973 | Rosfelder | |
| 3,728,891 A | | 4/1973 | Hall | |
| 4,221,356 A | * | 9/1980 | Fortune | B25B 11/005 248/363 |
| 5,176,346 A | * | 1/1993 | Liu | F16B 47/00 248/205.8 |
| 5,671,910 A | | 9/1997 | Davies | |

(Continued)

FOREIGN PATENT DOCUMENTS

| | | |
|---|---|---|
| CN | 1086163 | 5/1994 |
| CN | 1517229 | 8/2004 |

(Continued)

OTHER PUBLICATIONS

Andersson, H. et al; Evaluation of Coatings Applied to Flexible Substrates to Enhance Quality of Ink Jet Printed Silver Nano-Particle Structures; IEEE 342-348 V:2; #2 Feb. 2012.

(Continued)

*Primary Examiner* — Alejandro Valencia
(74) *Attorney, Agent, or Firm* — Steven R. Ormiston

(57) ABSTRACT

In one example, a media support includes a sheet of elongated suction cups. In another example, a media support includes an arrangement of elongated and/or circular suction cups in which the density of the suction cups varies between different parts of the support.

14 Claims, 10 Drawing Sheets

(56) References Cited

U.S. PATENT DOCUMENTS

| | | | | |
|---|---|---|---|---|
| 6,182,956 | B1 | 2/2001 | McMillan | |
| 6,346,154 | B1 | 2/2002 | Briend et al. | |
| 6,357,869 | B1 | 3/2002 | Rasmussen et al. | |
| 6,425,565 | B1 | 7/2002 | Montague | |
| 6,543,948 | B2 | 4/2003 | Beehler et al. | |
| 6,571,709 | B1 | 6/2003 | Marincic et al. | |
| 7,597,319 | B2 | 6/2009 | Dangelewicz et al. | |
| 7,556,421 | B2 * | 7/2009 | Lindbeck | B01F 11/0022 366/114 |
| 7,922,174 | B2 | 4/2011 | Panides et al. | |
| 8,038,151 | B2 | 10/2011 | Fukui | |
| 8,157,369 | B2 | 4/2012 | Hoover et al. | |
| 8,303,104 | B2 | 11/2012 | Miyagi | |
| 8,398,200 | B2 | 3/2013 | Higuchi | |
| 8,534,826 | B2 | 9/2013 | Kobayashi et al. | |
| 2009/0244242 | A1 | 10/2009 | Sawada | |
| 2009/0295898 | A1 | 12/2009 | Takatsuka | |
| 2010/0238249 | A1 | 9/2010 | Panides et al. | |
| 2011/0025796 | A1 | 2/2011 | Matsuya | |
| 2011/0043563 | A1 | 2/2011 | Houjou | |
| 2011/0102531 | A1 | 5/2011 | Ozaki | |
| 2011/0115867 | A1 * | 5/2011 | Forgacs | B65H 5/14 347/104 |
| 2011/0292145 | A1 | 12/2011 | Hoover et al. | |
| 2011/0317144 | A1 | 12/2011 | Baxter | |
| 2013/0162742 | A1 | 6/2013 | Inoue et al. | |
| 2014/0049590 | A1 | 2/2014 | Tateishi et al. | |
| 2014/0160213 | A1 | 6/2014 | Atwood | |

FOREIGN PATENT DOCUMENTS

| | | |
|---|---|---|
| CN | 101676106 | 3/2010 |
| CN | 201501166 | 6/2010 |
| CN | 101870204 | 10/2010 |
| CN | 102019769 A | 4/2011 |
| CN | 102431293 | 5/2012 |
| JP | 9166928 | 6/1997 |
| JP | 10520 | 1/1998 |
| JP | 2009107768 | 5/2009 |
| JP | 2012056097 | 3/2012 |
| WO | WO-9014952 | 12/1990 |
| WO | WO-2010008390 | 1/2010 |
| WO | WO-2012147760 | 11/2012 |

OTHER PUBLICATIONS

ODGS S & S, Vancouver ; How to Hold Media Flat on the Printer Table ; https://dgs.oce.com/PrinterSupport/Arizona, Jun. 11, 2007—3 pags.

PCT Search Report/Written Opinion—Application No. PCT/IL2013/051046 dated Jun. 23, 2014—18 pages.

Yi-ming, W. et al. ; Research on Inverse Seeking Designing Method for Suction Nozzle of Paper Separation Mechanism ; http://en.cnki.com.cn; 2005—3 pags.

* cited by examiner

MEDIA SUPPORT

CROSS REFERENCE TO RELATED APPLICATIONS

This is a continuation of U.S. application Ser. No. 14/908,197 filed Jan. 28, 2016 which is a 35 U.S.C. § 371 national stage filing of international application number PCT/IL2013/051046 filed Dec. 19, 2013, which claims priority to international application numbers PCT/IL2013/050932 filed Nov. 12, 2013 and PCT/IL2013/050639 filed Jul. 28, 2013, each of which applications is incorporated herein by reference in its entirety.

BACKGROUND

Large format inkjet printers use vacuum tables to hold down foamboard, cardboard and other inflexible or semi-flexible print media for printing. High capacity vacuum pumps are used to develop the hold down forces needed to keep large sheets of such media flat during printing.

DRAWINGS

The same part numbers designate the same or similar parts throughout the figures.

DESCRIPTION

Corrugated cardboard is widely used to make boxes. Although inkjet printers can print high quality images on corrugated cardboard, it is difficult to hold down corrugated cardboard flat in the print zone for high quality inkjet printing. Consequently, special, more expensive corrugated boards are often used for inkjet printing. A new print media support has been developed to hold down regular, less expensive corrugated cardboard flat for inkjet printing. In one example, the media support uses a sheet of suction cups overlaid on a vacuum table to increase the hold down force applied to corrugated cardboard and other print media. To reduce vacuum leakage and increase hold down forces, the suction cup sheet may include oval or other elongated suction cups or a combination of elongated and circular suction cups arranged so that the density of suction cups varies between different parts of the sheet. The suction cup sheet may be used with existing vacuum tables, thus enabling retrofitting printers already in use for high quality printing on corrugated cardboard. In another example, the suction cups are embedded in or integral to the vacuum table itself.

These and other examples are shown in the figures and described below with reference to supporting print media in an inkjet printer. Examples of the new media support, however, are not limited to inkjet printing or to supporting print media, but may be implemented to support other types of media and for applications other than inkjet printing. The examples shown and described illustrate but do not limit the invention, which is defined in the Claims following this Description.

An "elongated" suction cup as used in this document means a suction cup whose length is greater than its width.

Figure 1:
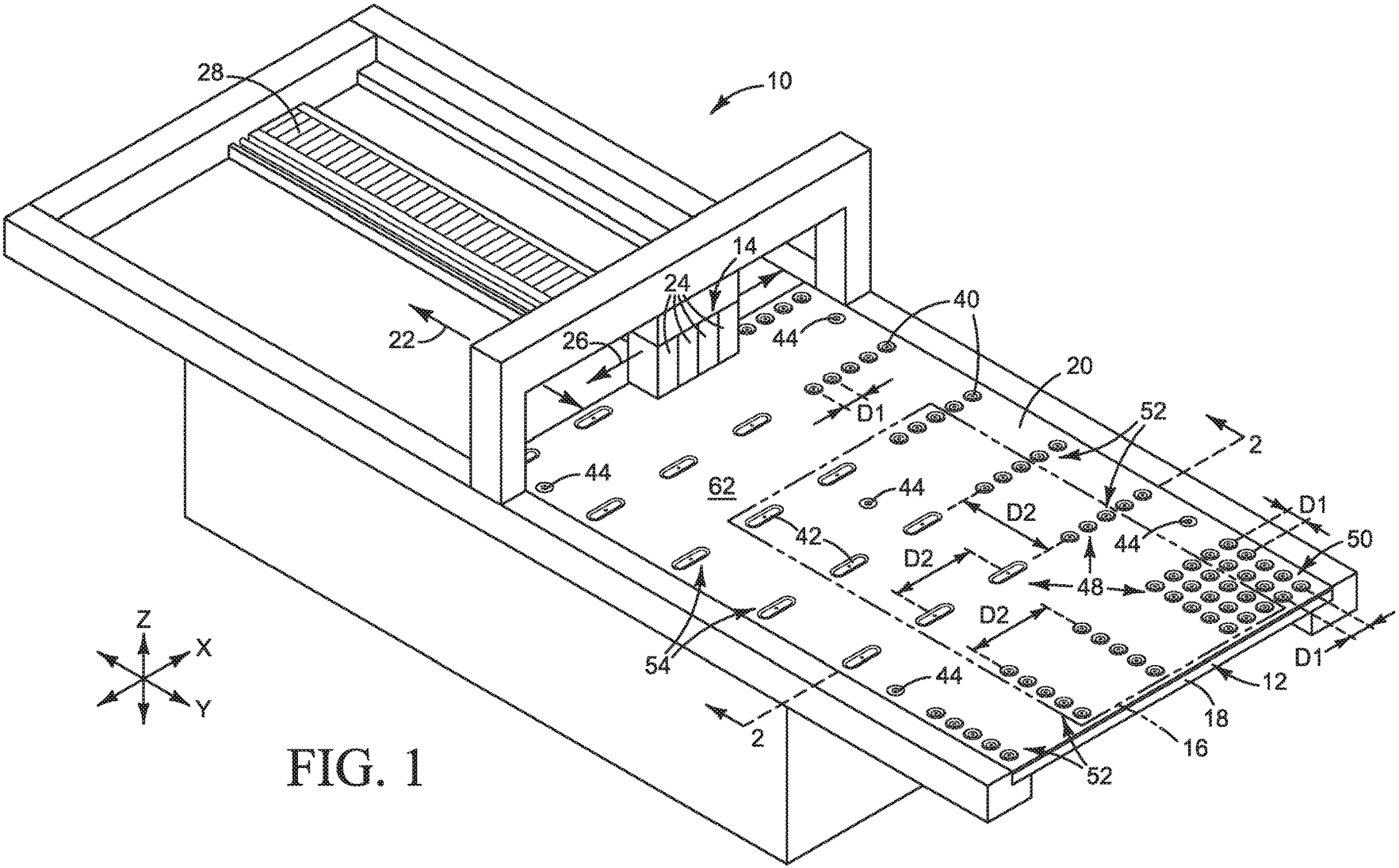
FIGS. 1 and 2 are perspective and section views illustrating an inkjet printer implementing one example of a media support that includes a detachable suction cup sheet.
Figure 2:
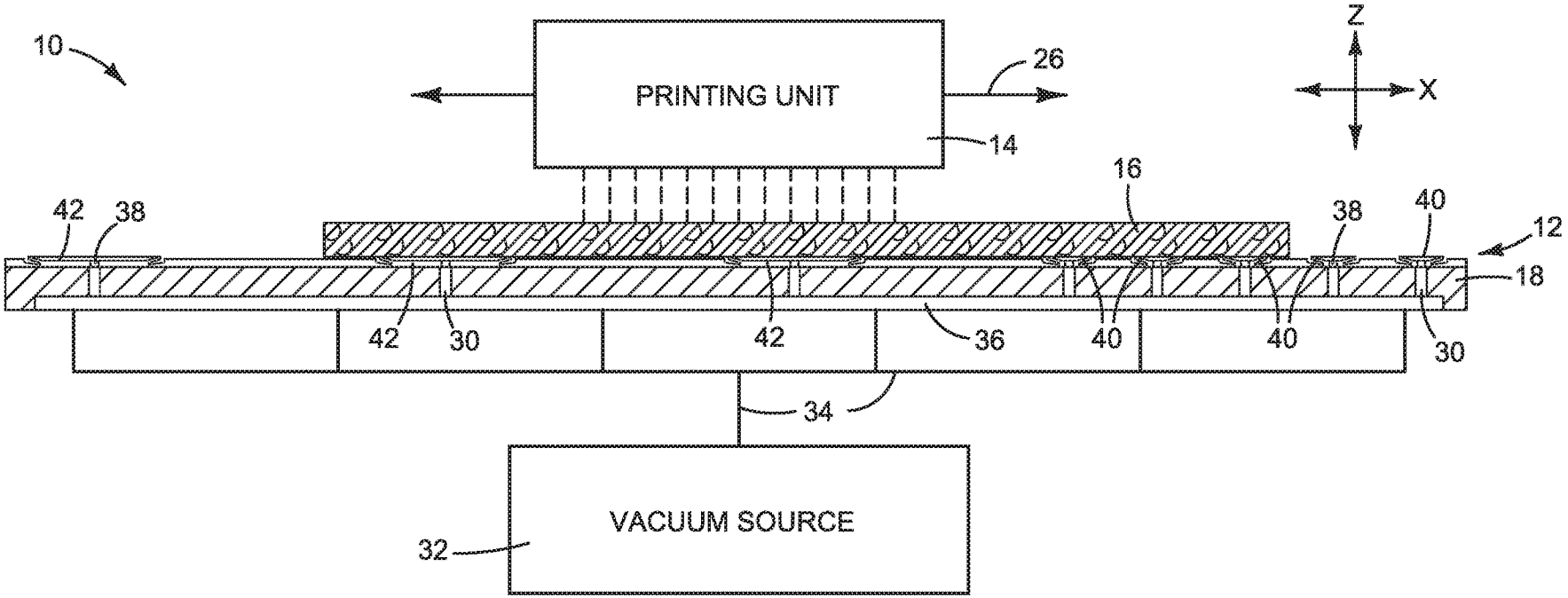
Figure 3:
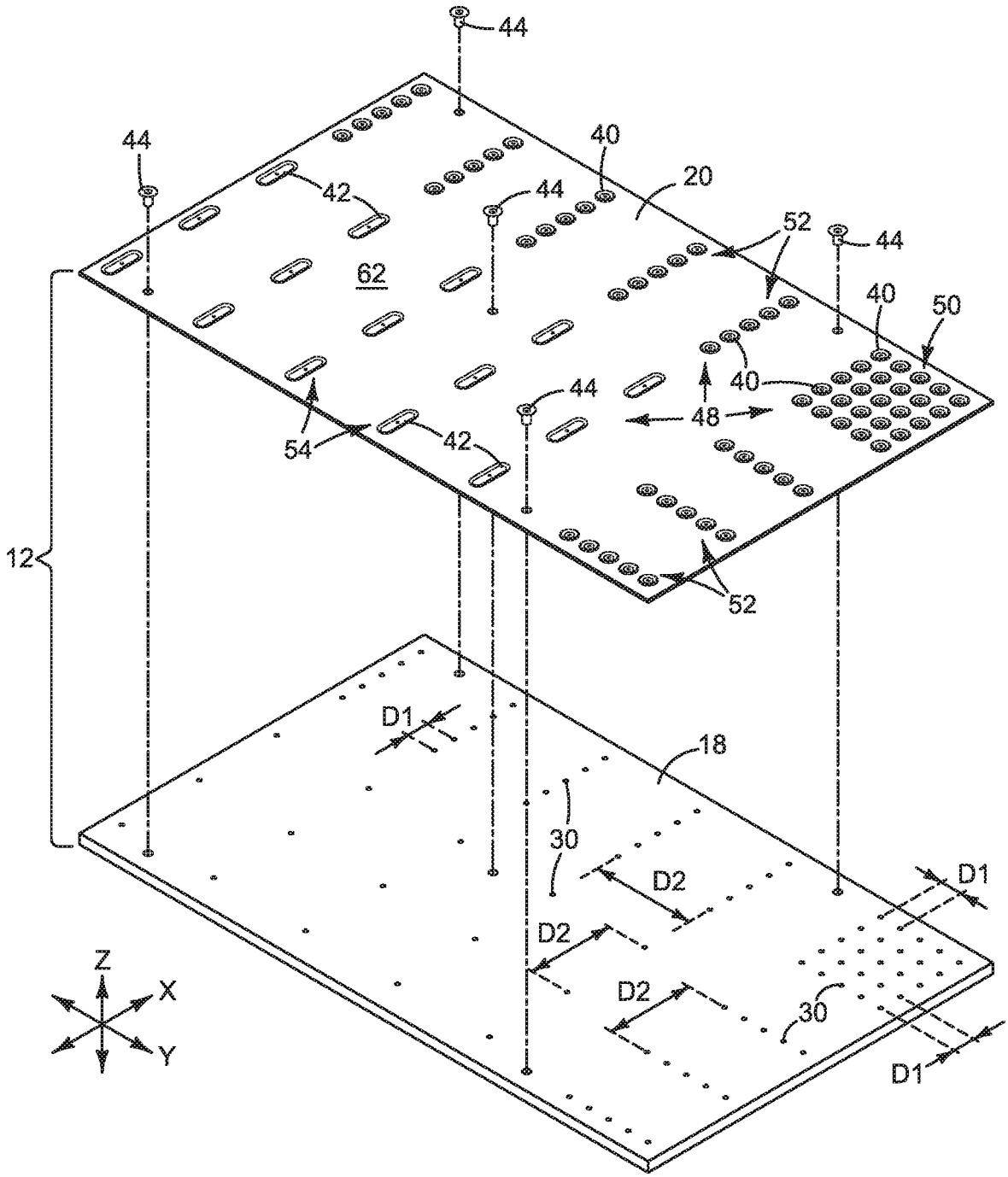
FIG. 3 is an exploded view of the media support shown in FIGS. 1 and 2.

FIGS. 1 and 2 are perspective and section views illustrating an inkjet printer 10 implementing one example of a media support 12 that includes a detachable suction cup sheet. The frame at each side of media support 12 is omitted from the section view of FIG. 2 to better illustrate the example shown. FIG. 3 is an exploded view of the media support 12 shown in FIGS. 1 and 2. Referring to FIGS. 1-3, printer 10 includes a printing unit 14 positioned over media support 12 supporting a sheet of corrugated cardboard or other print media 16. Only the outline of print media 16 is shown in FIG. 1. Print media 16 is omitted from FIG. 3.

Media support 12 includes a vacuum platen 18 and a suction cup sheet 20 covering platen 18. In the example shown, vacuum platen 18 is configured as a movable, flat plate to support large size print media 16. This type of vacuum platen is commonly referred to as a vacuum table. Vacuum table 18 is moved in the Y direction back and forth under printing unit 14 on a track or other suitable drive system 28, as indicated by arrows 22 in FIG. 1. Also in the example shown, printing unit 14 is configured as a group of ink pens 24 scanned back and forth over media 16 in the X direction, as indicated by arrows 26 in FIG. 1. Other suitable configurations are possible. For example, vacuum platen 18 could be configured as a rotating drum (covered by a flexible sheet 20), and/or printing unit 14 could be configured as a media wide array of stationary ink pens.

Holes 30 in vacuum table 18 are operatively connected to a pump or other vacuum source 32 through a network of tubes 34, plenum(s) 36, and controls (not shown). A port 38 at the back of each suction cup 40, 42 is aligned with a vacuum hole 30 when sheet 20 is installed on table 18. In operation, air is evacuated from cups 40, 42 through ports 38 under negative pressure from pump 32 to apply suction to print media 16. Vacuum control valves may be connected to individual suction cups or to groups of suction cups (or both) for vacuum control. For example, if print media 16 does not cover all of the suction cups 40, 42 in sheet 20, then it may be desirable to disconnect the vacuum to the uncovered suction cups to minimize vacuum leakage and thus reduce the capacity needed for pump 32. For another example, it may be desirable for holding some print media 16 to have fewer than all of the suction cups 40, 42 covered by print media 16 actually drawing a vacuum on the media.

For a detachable suction cup sheet 20, any suitable removable fastener may be used to attach sheet 20 to table 18 including, for example, adhesives, magnets or screws 44 shown in FIGS. 1 and 3 countersunk into the front surface of suction cup sheet 20. While it is expected that a detachable sheet 20 will be desirable for most implementations, a suction cup sheet 20 could be affixed to table 18 in a manner designed to be not detached from table 18.

Figure 5:
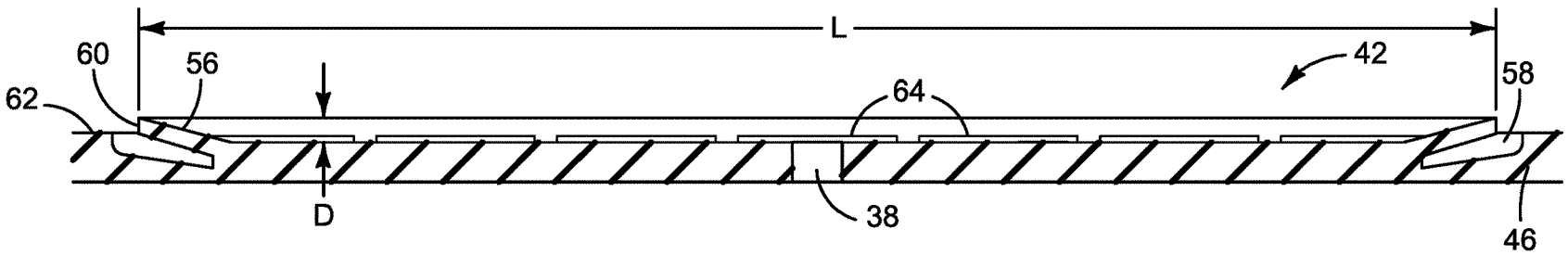

Continuing to refer to the example shown in FIGS. 1-3, suction cups 40, 42 are arranged on the body 46 (FIGS. 5 and 7) of sheet 20 in a pattern 48 that includes a first, more dense array 50 of circular suction cups 40 and underlying vacuum holes 30, second, less dense arrays 52 of circular suction cups 40 and underlying vacuum holes 30, and a third, still less dense array 54 of elongated suction cups 42 and underlying vacuum holes 30. The suction cups 40, 42 in arrays 50-54 and thus the corresponding vacuum holes 30 in table 18 are configured to minimize the number of vacuum holes 30 and suction cups 40, 42 needed to deliver the desired hold down forces to print media 16. In the example shown, circular suction cups 40 and holes 30 in highest density array 50 are spaced apart (on center) a first distance D1 in both the X and Y directions. Suction cups 40 and holes 30 in middle density arrays 52 are spaced apart first distance D1 in one direction (the X direction in FIGS. 1-3) and a second, longer distance D2 in the other direction (the Y direction in FIGS. 1-3). Elongated suction cups 42 and holes 30 in sparse array 54 are spaced apart the second distance D2 in both the X and Y directions. In one example of a varying density arrangement such as that shown in FIGS. 1-3, less dense arrays 52 and 54 include a uniform arrangement of suction cups 40, 42 and holes 30 in which the spacing between cups in the X direction or Y direction, or both, is an integer multiple of the most dense array 50 (e.g., D2÷D1=2, 3, 4 etc.) to help ensure the edges of print media 16 can be placed close to a line of suction cups.

Print media 16 is positioned on suction cup sheet 20 with one corner over dense part 50 and adjacent sides aligned over middle density arrays 52 so that the opposite sides of the print substrate are near a line of suction cups in sparse density array 54 as shown in FIG. 1. This positioning allows the application of greater suction along the perimeter of print media 16 where the risk of media un-flatness (curling, for example) is greater and lesser suction over an interior of media 16 where the risk of un-flatness is lesser. Other suitable configurations are possible. For example, more or fewer density variations may be used across suction cup sheet 20 and the spacing of the suction cups in each density array as well as the spacing between arrays may be varied as necessary or desirable to accommodate different sizes and types of print media 16. For another example, where, as here, a media sheet 16 may adjusted in both the X and Y directions within more dense arrays 50 and 52 (to place the opposite sides near a line of suction cups in sparse density array 54), it may be desirable to orient some or all of the elongated suction cups 42 lengthwise in the Y direction (rather than only in the X direction), in the X and Y directions (with "L" shaped or "+" shaped cups for example) and/or diagonally to the X and Y directions.

Figure 4:
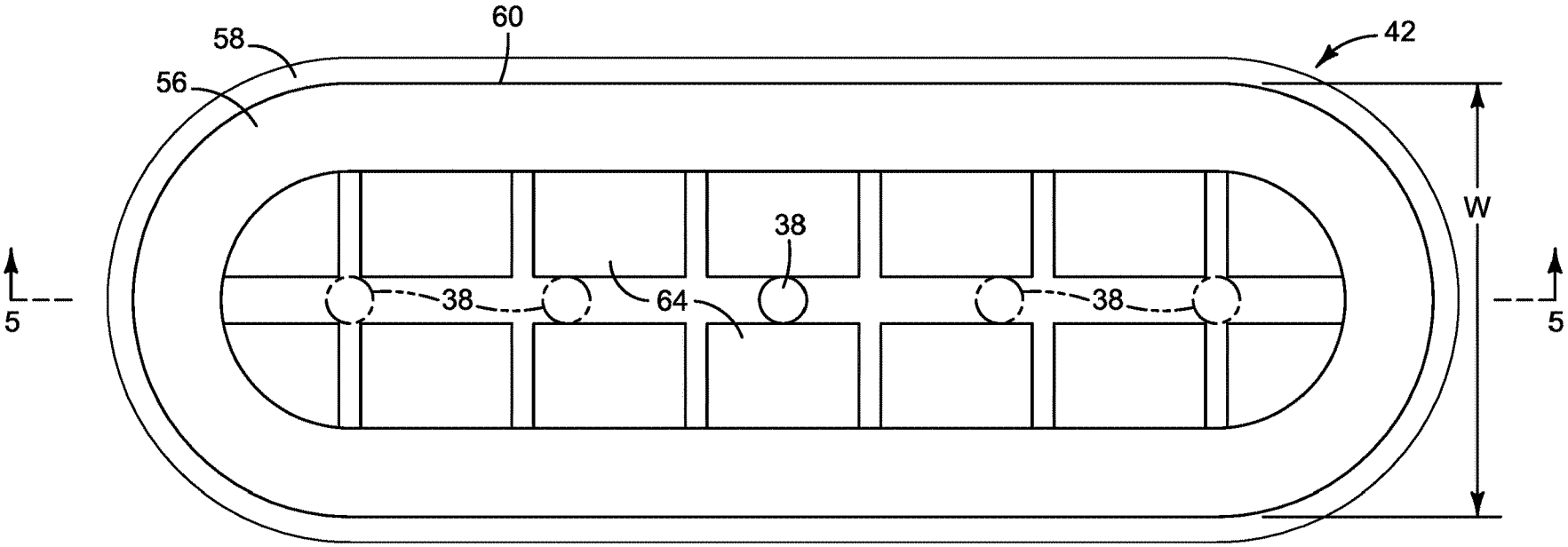
FIGS. 4 and 5 are detail views of one of the elongated suction cups from the suction cup sheet shown in FIGS. 1 and 2.

A suction cup sheet with all circular suction cups is disclosed in international patent application no. PCT/IL2013/050639 titled Media Support and filed Jul. 28, 2013. Although a suction cup sheet with a varying density of circular suction cups such as that disclosed in the '639 application is advantageous compared to regular vacuum tables, it has been discovered that the hold down forces generated in the areas of low density circular suction cups may be undesirably low for some printing applications. Elongated suction cups have been developed for use in lower density areas of the suction cup sheet to boost hold down forces and reduce gaps between suction cups. As best seen in the example shown in the detail views of FIGS. 4 and 5, each elongated suction cup 42 is characterized by a length L in a first direction (for example, the X direction in the layout of FIG. 1), a width W in a second direction orthogonal to the first direction (for example, the Y direction in the layout of FIG. 1), and a depth D in a third direction orthogonal to the first and second directions (for example, the Z direction in the figures). The length L of each elongated suction cup 42 is greater than its width W. For example, and referring to the detail views of FIGS. 4, 5 and 6, 7, each elongated suction cup 42 in lower density array 54 is approximately three times as long as a circular suction cup 40. In this example, elongated suction cups 42 are oval suction cups in which the ends are semi-circular and the width is approximately the same as the diameter of circular cups 40 (i.e., elongated circles). While it is expected that suction cups 42 usually will be elongated circles or other oval shapes, other elongated shapes may be suitable. For example, rectangular suction cups may be suitable in some implementations. For another example, "L" shaped, "+" shaped or other such multi-directional elongated suction cups may be desirable for some implementations.

Each suction cup 40, 42 is molded or otherwise integrated into sheet body 46. In the example shown, each suction cup 40, 42 includes a flexible ring 56 suspended in a recess 58 with a rim 60 protruding slightly above front surface 62 of body 46 so that cups 40, 42 can flex as suction is applied to print media 16. Rim 60 is formed at the perimeter of ring 56 which surrounds port 38 in space such that ring 56 may flex into recess 58 away from front surface 62 when print media 16 is sucked onto rim 60. Flexible rings 56 help suction cups 40, 42 conform to any waves, undulations and other irregularities typical of corrugated cardboard print media 16 so that each cup 40, 42 maintains a better seal to increase the hold down force.

Also in this example, each cup 40, 42 includes a series of ridges 64 adjacent to vacuum port(s) 38. Suction can pull print media 16 down onto the surface of ridges 64 as ring 56 flexes into recess 58 without blocking port 38. Sheet body 46 may be rigid or flexible depending on the implementation and, although any suitable material and fabrication technique may be used to form sheet 20, it is expected that a molded plastic sheet 20 will be desirable and cost effective for most printer implementations.

Figure 6:
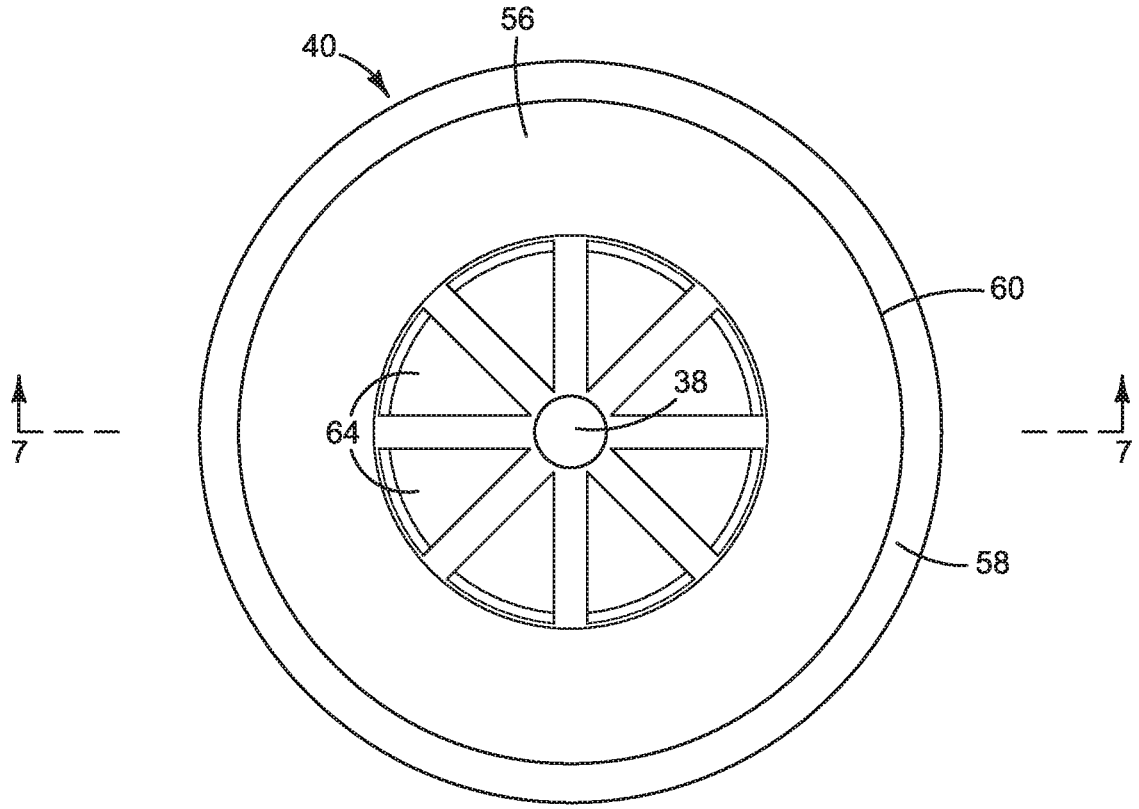
FIGS. 6 and 7 are detail views of one of the circular suction cups from the suction cup sheet shown in FIGS. 1 and 2.
Figure 7:
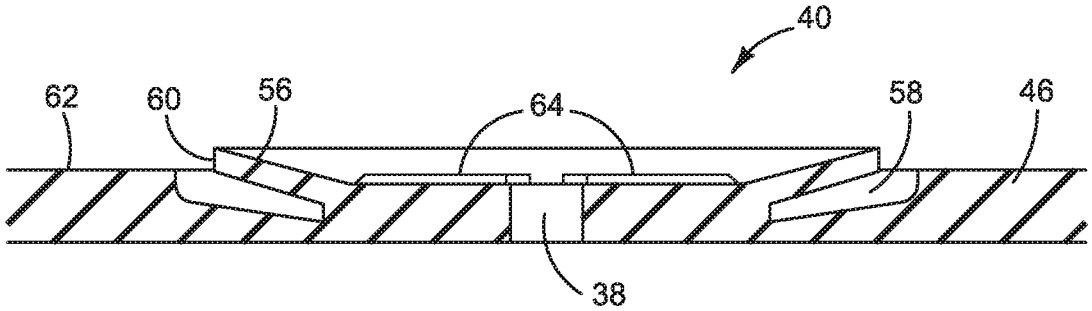

Testing indicates that, for the same vacuum line pressure, the hold down force applied by a circular suction cup 40 such as that shown in FIGS. 6 and 7 that is 10 mm-50 mm in diameter is more than 10 times greater than the hold down force applied by a vacuum hole 30 that is 2 mm-5 mm in diameter alone. Thus, significantly greater hold down forces may be applied through fewer vacuum holes. Oval suction cups 42 such as those shown in FIGS. 4 and 5 apply the increased hold down forces uniformly over a greater area compared to circular suction cups at the same radius. Suction cup sheet 20 may be fitted to existing vacuum tables so that large format printers already in use may be inexpensively retrofitted with detachable suction cup sheets 20 to more effectively print on corrugated cardboard. Where suction cups are not desired for printing, sheet 20 is not installed (or is removed if already installed) and print media 16 may be placed directly on vacuum table 18. Also, each elongated suction cup 42 may include multiple vacuum ports 38 to help sheet 20 align to existing vacuum tables that may have different vacuum hole configurations—extra vacuum ports 38 are indicated by phantom lines in FIG. 4.

Figure 8:
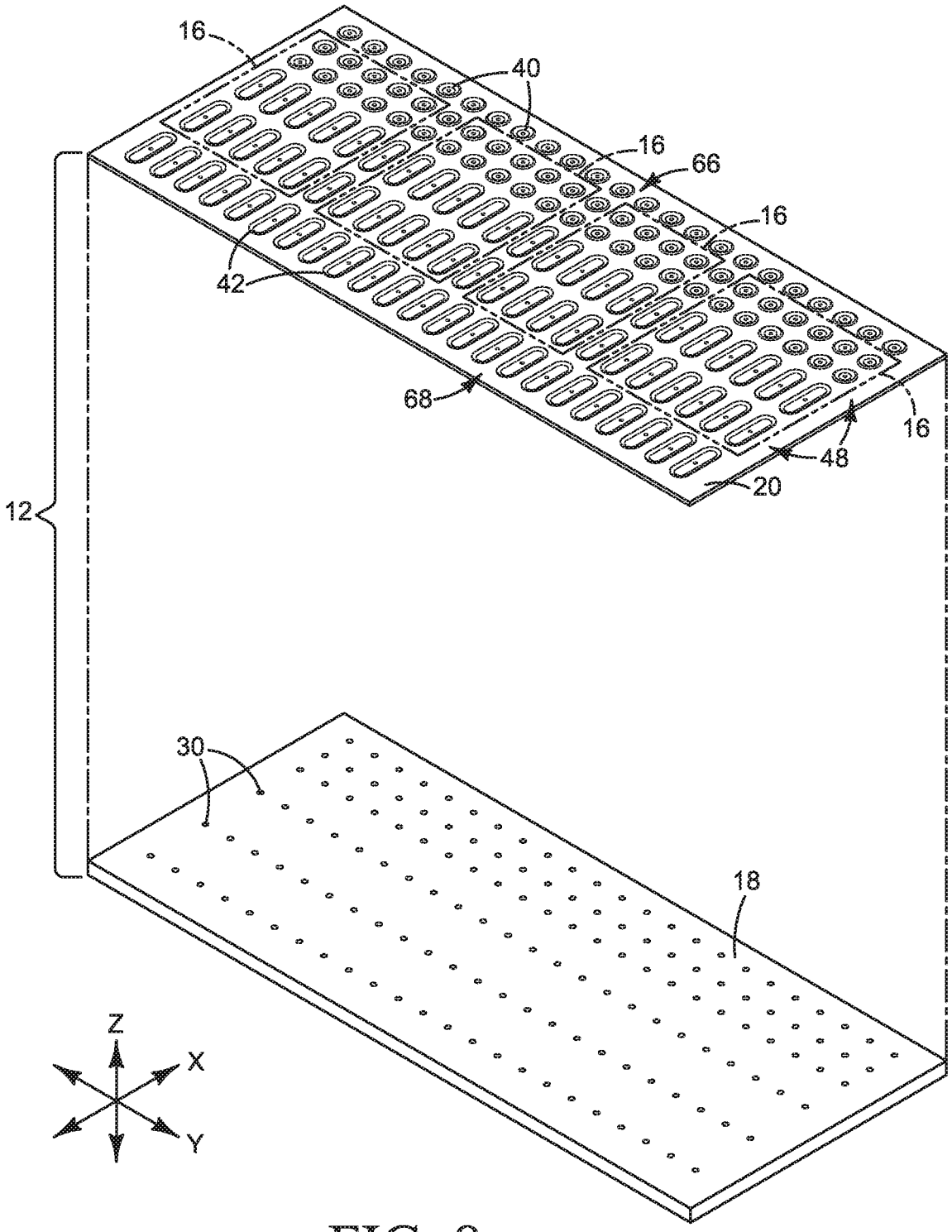
FIGS. 8-10 illustrate other examples of a media support with elongated suction cups.
Figure 9:
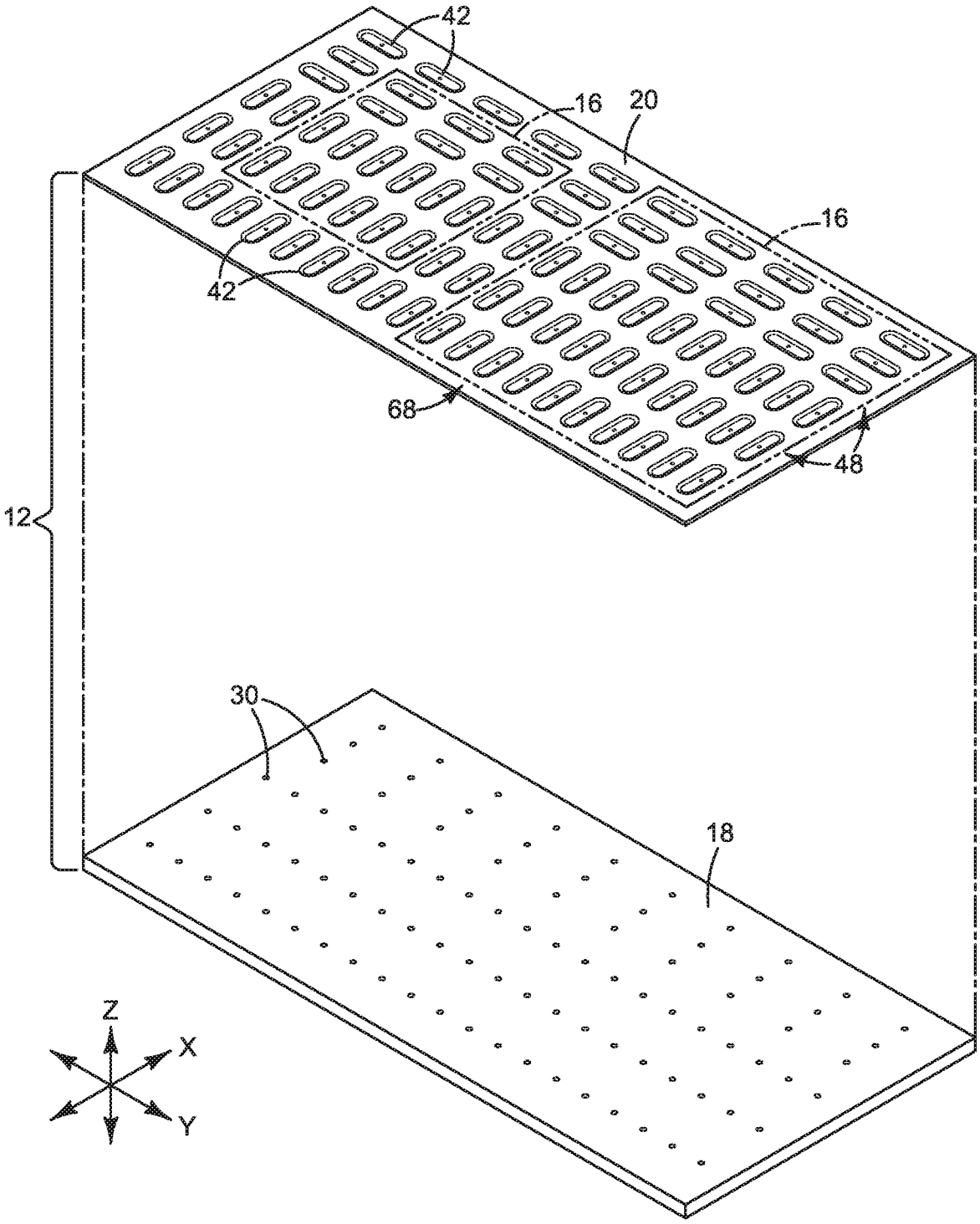
Figure 10:
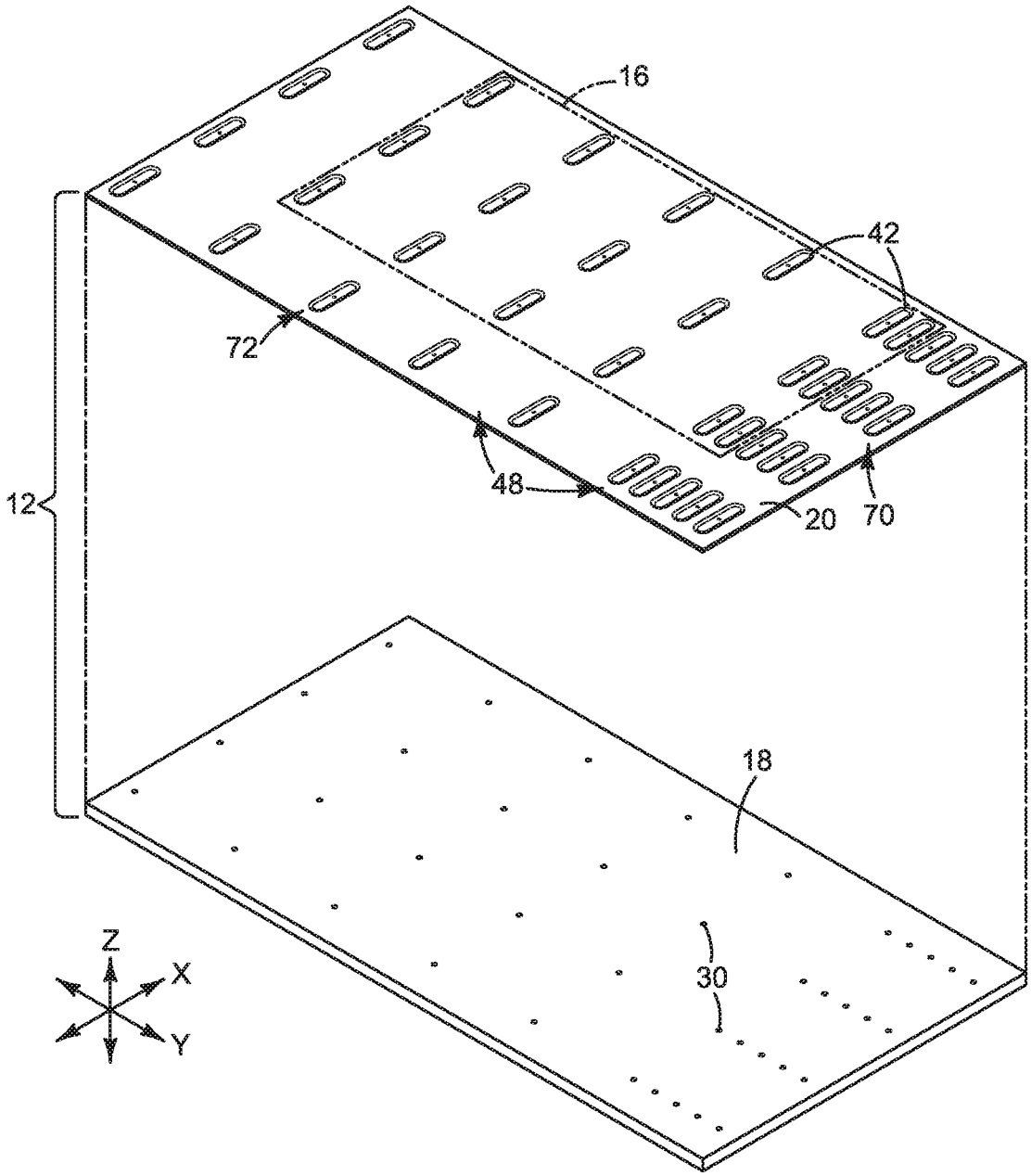

FIGS. 8-10 illustrate other examples of a suction cup sheet 20. In the example shown in FIG. 8, the suction cups are arranged in a pattern 48 that includes an array 66 of circular suction cups 40 closely spaced in both directions along one side of sheet 20 and an array 68 of elongated suction cups 42 closely spaced in both directions and evenly distributed over the remainder of sheet 20. Multiple cardboard panels or other sheet media 16 are supported on sheet 20 and arranged so that each edge of each panel lies over or close to a line of suction cups 40, 42. In the configuration of FIG. 8, the density of vacuum holes 30 in platen 18 varies only in the X direction. Although this configuration for vacuum holes 30 may have a lower vacuum efficiency compared to the configuration shown in FIG. 3, it is more versatile to hold one large sheet 16 or multiple smaller sheets 16.

In the example shown in FIG. 9, both arrays 66 and 68 are made up of elongated suction cups 42. Elongated suction cups 42 in array 66 are oriented lengthwise in the Y direction and elongated suction cups 42 in array 68 are oriented lengthwise in the X direction. It is expected that the arrangement 48 of suction cups 42 in FIG. 9 will deliver hold-down forces comparable to the arrangement of FIG. 8 with fewer vacuum holes 30 while still providing good versatility to handle one large sheet 16 or multiple smaller sheets 16.

In the example shown in FIG. 10, the suction cups are arranged in a pattern 48 that includes an array 70 of elongated suction cups 42 closely spaced in the Y direction and loosely spaced in the X direction and an array 72 of elongated suction cups 42 loosely spaced in both directions. A cardboard panel or other sheet media 16 is supported on sheet 20 and arranged so that each edge of the panel lies over or close to a line of suction cups 42.

Figure 11:
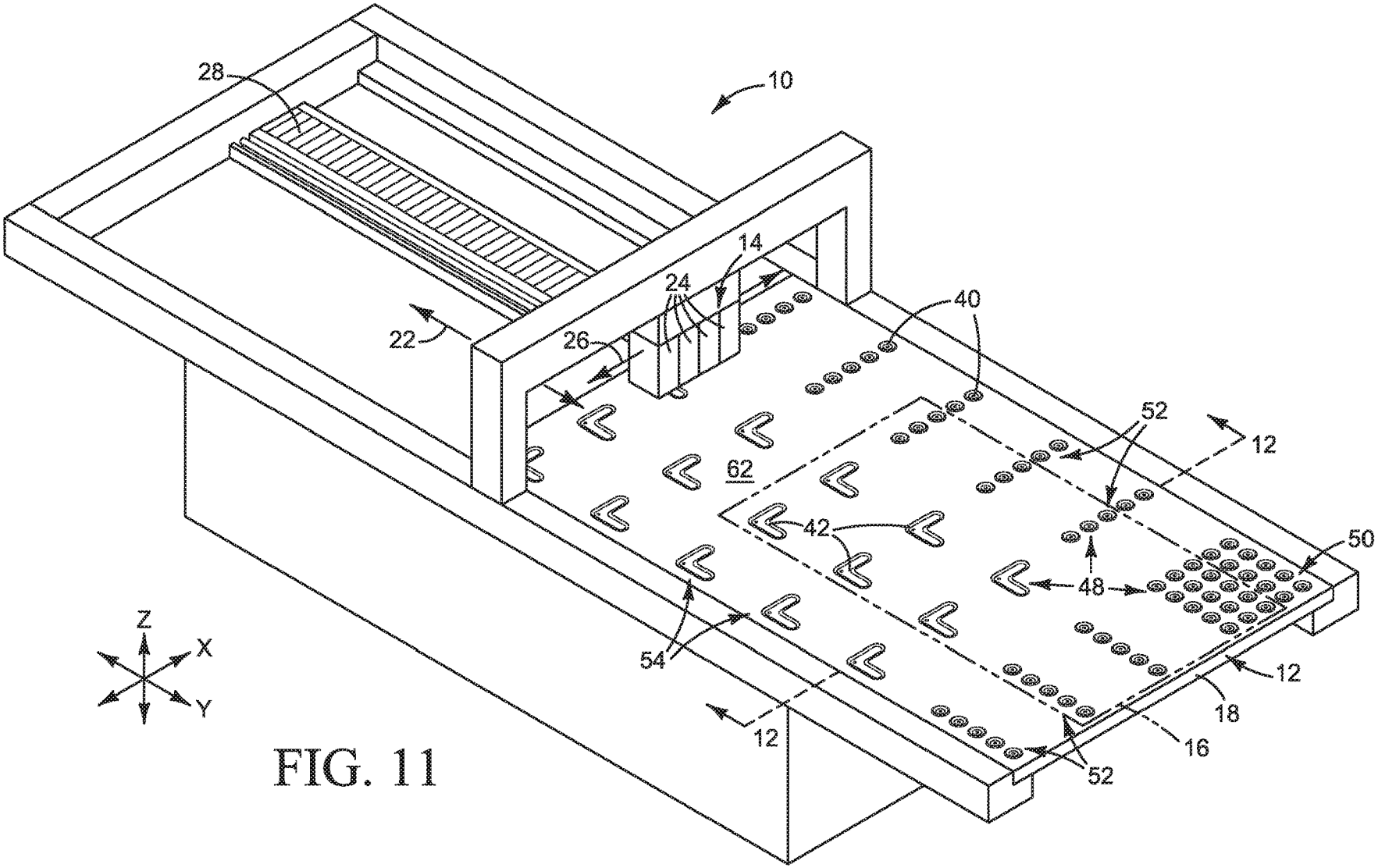
FIGS. 11 and 12 are perspective and elevation views illustrating an inkjet printer implementing an example of a media support that includes a suction cup table.
Figure 12:
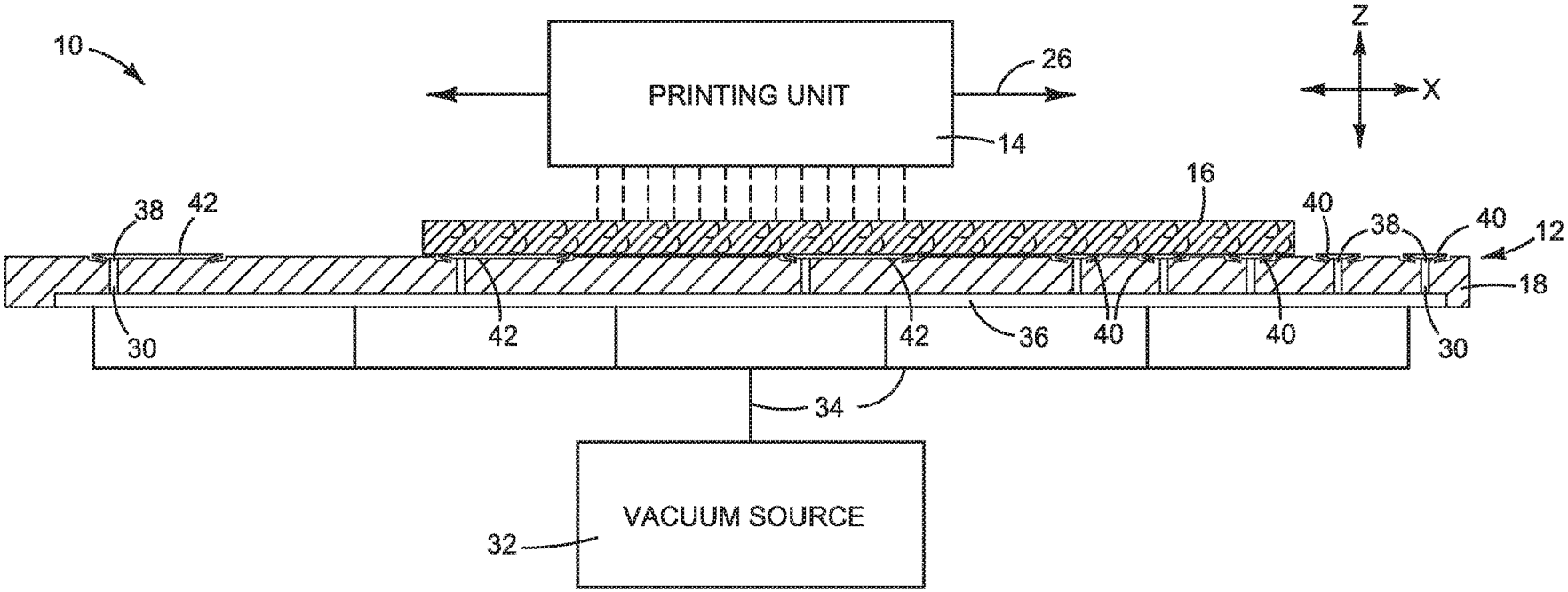

FIGS. 11 and 12 are perspective and elevation views illustrating an inkjet printer 10 implementing another example of a media support 12 in which the suction cups are part of platen 18. Referring to FIGS. 11 and 12, media support 12 includes a platen 18 and circular and elongated suction cups 40, 42 in platen 18. In the example shown, each elongated suction cup 42 is an "L" shaped suction cup with a port 38 at the corner of the L and with the arms of the L extending in the X and Y directions. Each suction cup 40, 42 may be an insert or other discrete part embedded in platen 18 or an integral part of platen 18. As best seen in FIG. 11, in this example, suction cups 40, 42 and vacuum holes 30 are arranged on platen 18 in the same pattern 48 of varying density arrays 50, 52, and 54 shown in FIG. 1 for suction cup sheet 20 except that each elongated suction cup 42 extends lengthwise in both the X and Y directions to expand the area of print media 16 covered by suction cups 42 and to reduce the gaps between suction cups in the X direction.

"A" and "an" as used in the Claims means one or more.

The examples shown in the figures and described above illustrate but do not limit the invention, which is defined in the following Claims. Other forms, details, and examples may be made and implemented. Therefore, the foregoing description should not be construed to limit the scope of the Claims.

What is claimed is:

1. A media support, comprising a sheet of elongated suction cups, wherein:

each elongated suction cup has a length in a first direction, a width in a second direction orthogonal to the first direction, and a depth in a third direction orthogonal to the first and second directions, the length being greater than the width, and each elongated suction cup having a port through which air may be evacuated from the elongated suction cup with each port separate from the port of any other elongated suction cup; and the sheet includes circular suction cups each having a port through which air may be evacuated from the circular suction cup, with a first array of only circular suction cups grouped together in one corner of the sheet and an array of only elongated suction cups in another part of the sheet, the suction cups in the first array of only circular suction cups arrayed in a first density and the suction cups in the array of only elongated suction cups arrayed in a second density less than the first density.

2. The media support of claim 1, with a second array of only circular suction cups arranged in a series of lines along only two sides of the sheet that meet at the one corner.

3. The media support of claim 1, wherein the sheet comprises a flexible sheet.

4. The media support of claim 1, wherein the length of each elongated suction cup is oriented parallel to the length of each of the other elongated suction cups.

5. The media support of claim 1, wherein the length of some of the elongated suction cups is oriented perpendicular to the length of other of the elongated suction cups.

6. A media support, comprising:

a platen having an array of vacuum holes therein through which vacuum may be applied to media on the platen; and a sheet of elongated suction cups covering the platen, wherein each elongated suction cup has a length in a first direction, a width in a second direction orthogonal to the first direction, and a depth in a third direction orthogonal to the first and second directions, the length being greater than the width, and each of the elongated suction cups having a port through which air may be evacuated from the elongated suction cup with each port separate from the port of any other elongated suction cup and each port aligned to a vacuum hole on the platen so that vacuum may be applied to the elongated suction cup through the vacuum hole;

wherein the sheet includes circular suction cups each having a port through which air may be evacuated from the circular suction cup and aligned to a vacuum hole on the platen so that vacuum may be applied to the circular suction cup through the vacuum hole, with an array of only circular suction cups grouped together in one corner of the sheet and an array of only elongated suction cups spread over another part of the sheet, the array of only circular suction cups arrayed in a first density and the array of only elongated suction cups arrayed in a second density less than the first density.

7. The media support of claim 6, wherein the sheet is detachable from the platen.

8. The media support of claim 6, wherein each elongated suction cup includes a flexible ring surrounding the port in a recess such that the ring may flex into the recess when suction is applied to media supported on the sheet.

9. The media support of claim 1, wherein some or all of the elongated suction cups are oval suction cups.

10. The media support of claim 1, wherein some of or all of the elongated suction cups are L shaped and the port of each L shaped suction cup is located at the corner of the L.

11. The media support of claim 6, wherein the sheet comprises a flexible sheet detachable from the platen.

12. A media support, comprising:

a platen having an array of vacuum holes therein through which vacuum may be applied to media on the platen; and a flexible sheet having elongated suction cups and circular suction cups therein covering the platen, wherein each elongated suction cup has a length in a first direction, a width in a second direction orthogonal to the first direction, and a depth in a third direction orthogonal to the first and second directions, the length being greater than the width, and each of the suction cups having a port through which air may be evacuated from the suction cup with each port separate from the port of any other suction cup and each port aligned to a vacuum hole on the platen so that vacuum may be applied to the suction cup through the vacuum hole, the elongated suction cups arranged in a first array over a first part of the sheet and the circular suction cups arranged in a second array over a second part of the sheet not overlapping the first part of the sheet.

13. The media support of claim 12, wherein the second part of the sheet includes one corner of the sheet and some or all of the circular suction cups in the second array are grouped together in the one corner.

14. The media support of claim 13, wherein the in the first array is less dense than the second array.

* * * * *